US012733671B2

(12) United States Patent
Moon et al.

(10) Patent No.: US 12,733,671 B2
(45) Date of Patent: Sep. 15, 2026

(54) MANUFACTURE OF GAS EMISSION MEDIUM FOR ENHANCING MIGRATION AMOUNT OF ACTIVE INGREDIENTS

(71) Applicant: KT&G CORPORATION, Daejeon (KR)

(72) Inventors: Sungmin Moon, Daejeon (KR); Donghyun Lee, Daejeon (KR); Ikjang Choi, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 525 days.

(21) Appl. No.: 18/032,691

(22) PCT Filed: Dec. 14, 2022

(86) PCT No.: PCT/KR2022/020338

§ 371 (c)(1),
(2) Date: Apr. 19, 2023

(87) PCT Pub. No.: WO2023/128405

PCT Pub. Date: Jul. 6, 2023

(65) Prior Publication Data

US 2024/0373901 A1 Nov. 14, 2024

(30) Foreign Application Priority Data

Dec. 30, 2021 (KR) ..... 10-2021-0192442

(51) Int. Cl.
*A24B 15/28* (2006.01)
*A24B 3/14* (2006.01)
(Continued)

(52) U.S. Cl.
CPC ..... *A24B 15/283* (2013.01); *A24B 3/14* (2013.01); *A24B 13/02* (2013.01); *A24B 15/14* (2013.01); *A24B 15/303* (2013.01); *A24D 1/002* (2013.01); *A24D 1/20* (2020.01); *A24D 3/0279* (2013.01); *A24D 3/04* (2013.01); *A24D 3/10* (2013.01)

(58) Field of Classification Search
CPC ..... A24B 15/283
See application file for complete search history.

(56) References Cited

U.S. PATENT DOCUMENTS 5,551,450 A 9/1996 Hemsley
2013/0152953 A1 6/2013 Mua et al.

FOREIGN PATENT DOCUMENTS

CN 104560392 A 4/2015
CN 105249518 A 1/2016
(Continued)

OTHER PUBLICATIONS

JP-2015504658-A, English machine translation (Year: 2015).*
(Continued)

*Primary Examiner* — Michael H. Wilson
*Assistant Examiner* — Michael T Fulton
(74) *Attorney, Agent, or Firm* — Sughrue Mion, PLLC

(57) ABSTRACT

The present disclosure provides an aerosol-generating material including a reconstituted tobacco leaf slurry, wherein the reconstituted tobacco leaf slurry contains sugar crystals containing a gas therein, and provides a method for preparing the aerosol-generating material and an aerosol-generating article including the aerosol-generating material.

5 Claims, 3 Drawing Sheets

(51) Int. Cl.

| | |
|---|---|
| ***A24B 13/02*** | (2006.01) |
| ***A24B 15/14*** | (2006.01) |
| ***A24B 15/30*** | (2006.01) |
| ***A24D 1/00*** | (2020.01) |
| ***A24D 1/20*** | (2020.01) |
| ***A24D 3/02*** | (2006.01) |
| ***A24D 3/04*** | (2006.01) |
| ***A24D 3/10*** | (2006.01) |

(56) References Cited

FOREIGN PATENT DOCUMENTS

| | | | | | |
|---|---|---|---|---|---|
| CN | 110121272 | A | | 8/2019 | |
| CN | 113365516 | A | | 9/2021 | |
| EP | 0 419 974 | A2 | | 4/1991 | |
| JP | 2015504658 | A | * | 2/2015 | ..... A24B 15/18 |
| KR | 10-1982720 | B1 | | 5/2019 | |
| KR | 10-2020-0018354 | A | | 2/2020 | |
| KR | 10-2020-0101365 | A | | 8/2020 | |
| TW | 202138444 | A | | 10/2021 | |
| WO | WO-2017153443 | A1 | * | 9/2017 | ..... H05B 6/105 |
| WO | WO-2018229087 | A1 | * | 12/2018 | ..... A24B 3/14 |
| WO | 2020/032715 | A1 | | 2/2020 | |

OTHER PUBLICATIONS

International Search Report for PCT/KR2022/020338 dated Mar. 16, 2023.

Communication dated Sep. 22, 2025 in Chinese Application No. 202280008130.2.

"Slurry", Slurry Definition & Meaning—Merriam-Webster, 2000 (1 page).

Marcela Maira N. S. Soares, et al., "The effect of calcination conditions on the physical and chemical characteristics of sugar cane bagasse ash", SciELO—Brazil, Mar. 1, 2014 (11 pages).

Extended European Search Report issued May 8, 2024 in Application No. 22905472.1.

Korean Office Action issued Dec. 20, 2023 in Application No. 10-2021-0192442.

* cited by examiner

MANUFACTURE OF GAS EMISSION MEDIUM FOR ENHANCING MIGRATION AMOUNT OF ACTIVE INGREDIENTS

CROSS REFERENCE TO RELATED APPLICATIONS

This application is a National Stage of International Application No. PCT/KR2022/020338 filed Dec. 14, 2022, claiming priority based on Korean Patent Application No. 10-2021-0192442 filed Dec. 30, 2021.

TECHNICAL FIELD

The following description relates to a gas emission medium for enhancing the migration amount of active ingredients and a method for manufacturing the same.

BACKGROUND ART

In general, tobacco refers to perennials of the dicotyledonous plant Solanaceae, but recently, tobacco leaves are wrapped in cigarette paper, and a filter part is configured in one side thereof so that it may collectively refers to products manufactured for the purpose of smoking. There are thousands of species of such tobacco worldwide, and they are released in various shapes and forms.

As an alternative to compensate for the disadvantages of combustion-type tobacco, which is lit and smoked like cigarettes, cigars, and pipe tobacco among these, a method in which an aerosol is generated as an aerosol-generating material in the cigarette is heated, rather than a method of generating an aerosol by burning the cigarette, is widely used, and the demand for it is increasing. Accordingly, research on a heating-type (non-combustion type) cigarette or a heating-type (non-combustion type) aerosol-generating system is being actively conducted.

Specifically, the aerosol-generating system has a shape similar to conventional combustion-type cigarettes, and generates mainstream smoke containing an aerosol by heating an aerosol-generating material in the heating-type (non-combustion type) cigarette through a method such as a heater or ultrasonic vibration. Therefore, the aerosol-generating system has the advantage of minimizing the emission of ingredients in cigarettes while performing a function of satisfying the smoker's smoking desire, forming a new market that replaces conventional combustion type cigarettes.

Meanwhile, in a migration method through heating of an existing tobacco medium part in relation to such an aerosol-generating system, active ingredients migrate smoothly on the surface of a reconstituted tobacco leaf slurry of the tobacco medium part, whereas there is a problem in that the diffusion of the ingredients inside the slurry is not easy.

Diffusion and migration of active ingredients is one of the important factors in terms of functionality of electronic cigarettes expected by consumers, and unless the medium is pulverized with a separate external force, the surface area of the medium becomes a factor determining the level of diffusion and migration of the ingredients.

Accordingly, there is a limitation in delivering active ingredients inside a tobacco medium through heating, and there is a problem that a certain amount or more of the reconstituted tobacco leaf slurry included in the tobacco medium part is required to satisfy the target migration amount of the active ingredients. In addition, there is also a problem that the active ingredients remaining without being migrated to the inside of the reconstituted tobacco leaf slurry after smoking may be wasted.

DISCLOSURE OF THE INVENTION

Technical Goals

Accordingly, in order to overcome the problems and/or limitations of the existing technologies as described above, an object of the present disclosure is to provide a gas emission medium for enhancing the migration amount of active ingredients and a method for manufacturing the same.

However, the problems to be solved by the present disclosure are not limited to the problems mentioned above, and other problems not mentioned will be clearly understood by those skilled in the art from the description below.

Technical Solutions

According to one embodiment of the present disclosure, there is provided an aerosol-generating material including a reconstituted tobacco leaf slurry, wherein the reconstituted tobacco leaf slurry contains sugar crystals containing a gas therein.

According to one aspect, there is provided an aerosol-generating article comprising a tobacco medium part and a filter part, wherein the tobacco medium part contains an aerosol-generating material, the aerosol-generating material includes a reconstituted tobacco leaf slurry, the reconstituted tobacco leaf slurry contains sugar crystals containing a gas therein, and the filter part includes a cooling part.

According to another aspect of the present disclosure, there is provided a method for preparing an aerosol-generating material, the method comprising the steps of:

a) melting sugar at a temperature of 120° C. to 150° C. and injecting a gas into a liquid phase of the sugar:

b) forming sugar crystals by cooling the gas-injected sugar to 50° C. to 90° C.:

c) mixing an adhesive and the sugar crystals with a reconstituted tobacco leaf slurry: and d) processing the mixed reconstituted tobacco leaf slurry.

Effects

According to one aspect of the present disclosure, when a reconstituted tobacco leaf slurry containing gases such as carbon dioxide and the like are contained in an aerosol-generating material, sugar is melted in a process of heating an electronic tobacco medium part so that carbon dioxide inside the electronic tobacco medium part is emitted to the outside, and at the same time, the inside of the medium is exposed to increase the surface area so that active ingredients inside the tobacco medium can be easily migrated.

Further, since the holes are not formed in advance during manufacturing compared to the case of manufacturing a tobacco stick by forming porous holes in advance in order to increase the surface area, there is no risk of weakening the strength, making it easier to perform a stick manufacturing operation, and since a tobacco medium with a larger surface area can be used when smoking, the migration amount of the active ingredients can be further improved compared to the same amount of a conventional tobacco medium.

Furthermore, since a sugar ingredient, which serves as the outer shell of sugar crystals, not only can serve to retain compressed carbon dioxide, but also can exhibit the effect of generating pyrazine-based flavor ingredients through Maillard reaction when the tobacco medium part is heated, the satisfaction of the smoker can be finally improved.

Furthermore, the present technology has the advantage that it can be applied not only to conventional cigarettes but also to technologies such as alternative cigarettes in which the delivery of a specific active ingredient is a priority goal.

The effects of the present disclosure are not limited to the above effects, and should be understood to include all effects that can be inferred from the configuration of the invention described in the detailed description or claims of the present disclosure.

BEST MODE FOR CARRYING OUT THE INVENTION

Figure 1:
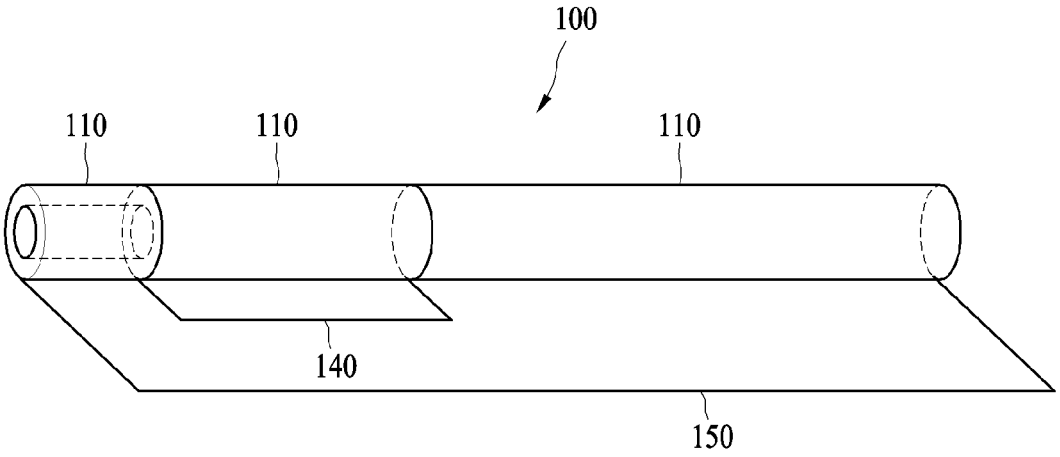
FIG. 1 is a view showing the configuration of an aerosol-generating article comprising a front end plug according to one embodiment of the present disclosure.
Figure 2:
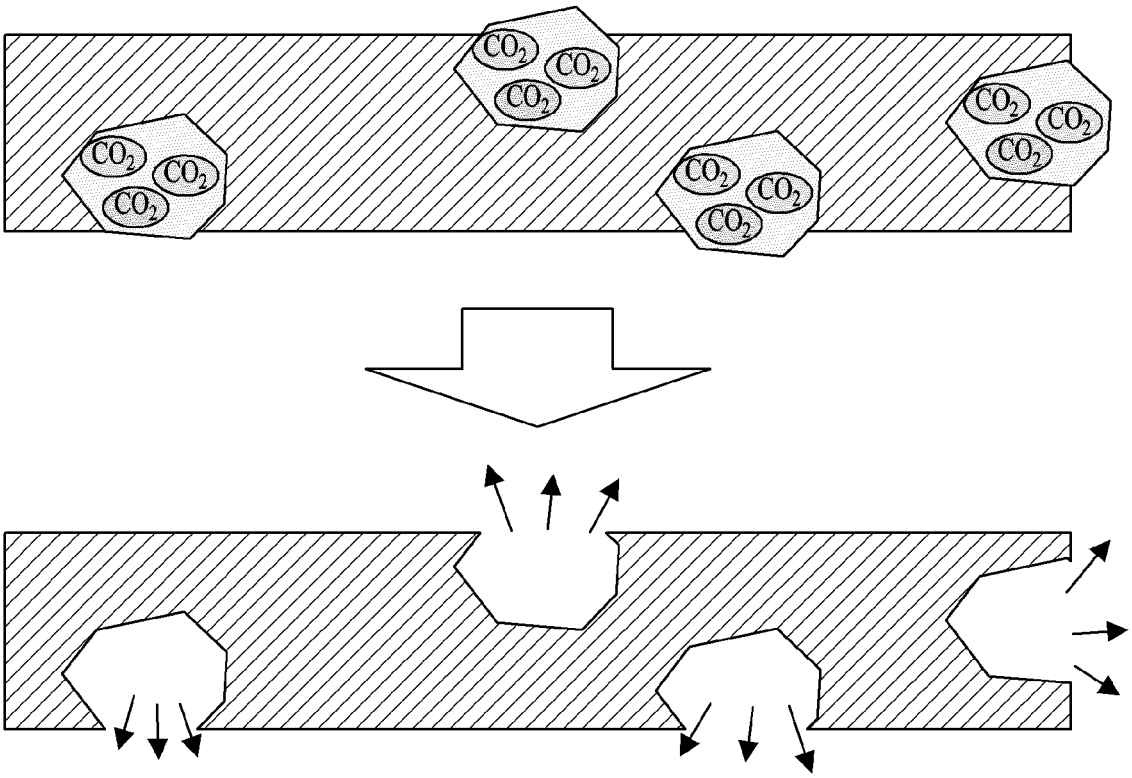
FIG. 2 is a view showing how internal ingredients migrate while a gas inside sugar crystals is emitted when a reconstituted tobacco leaf slurry according to one embodiment of the present disclosure is processed into a sheet form.
Figure 3:
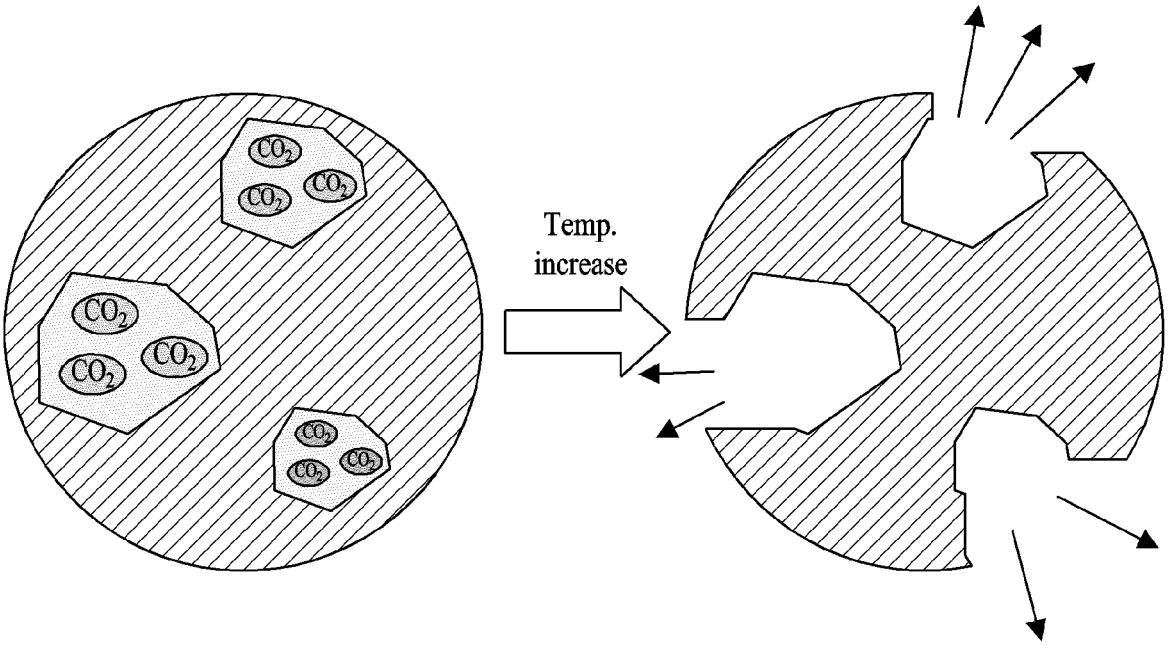
FIG. 3 is a view showing how internal ingredients migrate while a gas inside sugar crystals is emitted when a reconstituted tobacco leaf slurry according to one embodiment of the present disclosure is processed into a spherical shape.
Figure 4:
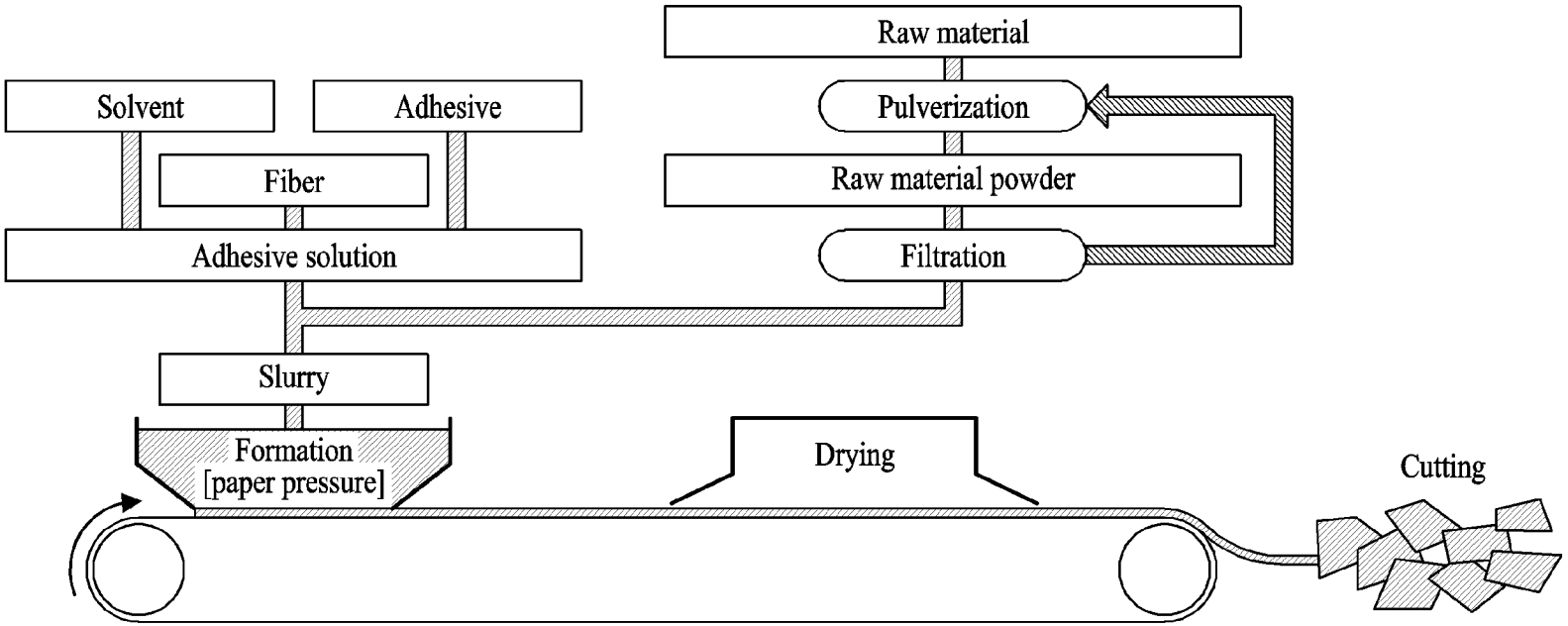
FIG. 4 is a view schematically showing a method of processing a reconstituted tobacco leaf slurry by a band casting method according to one embodiment of the present disclosure.

Hereinafter, embodiments will be described in detail with reference to the accompanying drawings. However, since various changes may be made to the embodiments, the scope of rights of the patent application is not restricted or limited by these embodiments. It should be understood that all modifications, equivalents, and substitutes for the embodiments are included in the scope of the rights.

The terms used in the embodiments are used for the purpose of description only, and should not be construed as an intention to limit the present disclosure. The singular expression includes the plural expression unless the context clearly dictates otherwise. In the present specification, it should be understood that a term such as "comprise", "have", or the like is intended to designate that a feature, a number, a step, an operation, a component, a part, or a combination thereof described in the specification exists, but it does not preclude the possibility of existence or addition of one or more other features, numbers, steps, operations, components, parts, or combinations thereof.

Unless defined otherwise, all terms used herein, including technical or scientific terms, have the same meaning as those commonly understood by those skilled in the art to which the embodiments belong. Terms such as those defined in a commonly used dictionary should be interpreted as having a meaning consistent with the meaning in the context of the related art, and should not be interpreted in an ideal or excessively formal meaning unless explicitly defined in the present application.

Further, in the description with reference to the accompanying drawings, the same components are assigned the same reference numerals regardless of the reference numerals, and overlapping descriptions thereof will be omitted. In the description of the embodiments, if it is determined that a detailed description of a related known technology may unnecessarily obscure the gist of the embodiments, the detailed description thereof will be omitted.

Further, in describing constituent elements of the embodiments, terms such as first, second, A, B, (a), (b), etc. may be used. These terms are only for distinguishing the constituent elements from other constituent elements, and essences, orders, or sequences of the corresponding constituent elements are not limited by the terms.

Constituent elements included in any one embodiment and constituent elements including a common function will be described using the same names in other embodiments. Unless otherwise stated, descriptions described in any one embodiment may also be applied to other embodiments, and detailed descriptions will be omitted in the overlapping range.

Throughout the specification, an 'aerosol-generating article' may refer to an article that may comprise an aerosol-generating material or an aerosol-forming substrate. In addition, the aerosol-generating article may comprise a solid material (aerosol-generating material) based on tobacco raw materials such as reconstituted tobacco leaf tobacco, cut tobacco, and reconstituted tobacco. The aerosol-generating material May include volatile compounds.

An 'aerosol-generating system' in the present disclosure may refer to a device for generating an aerosol using an aerosol-generating article in order to generate an aerosol that can be directly inhaled into the user's lungs through the mouth of a user. The aerosol-generating system is a non-combustion type tobacco article that is indirectly heated by electrical energy rather than direct combustion. The non-combustion type tobacco article includes a heating type tobacco article and a non-heating type tobacco article. In the present disclosure, it is preferable to use aerosol-generating system in heating type tobacco. The heating type tobacco article may be an article that sucks ambient air heated through electrical energy to generate an aerosol, and allows smoking to be achieved by a method of emitting the aerosol after such an aerosol is inhaled into the user. For example, a hybrid type aerosol-generating device using a liquid phase cartridge and a cigarette together may be included, and various types of aerosol-generating devices may be further included in addition thereto so that the scope of the present disclosure is not limited to the above-described examples.

Further, throughout the specification, 'upstream' or 'upstream direction' refers to a direction away from the mouth of a user smoking the aerosol-generating article 100, and 'downstream' or 'downstream direction' refers to a direction approaching from the mouth of the user smoking the aerosol-generating article 100. For example, in the aerosol-generating article 100 shown in FIG. 1, the tobacco medium part 120 is located upstream or in an upstream direction of the filter part 130.

According to one embodiment of the present disclosure, there is provided an aerosol-generating material comprising a reconstituted tobacco leaf slurry, wherein the reconstituted tobacco leaf slurry contains sugar crystals containing a gas therein.

Sugar crystals according to one embodiment of the present disclosure may contain a gas such as carbon dioxide ($CO_2$) or the like inside a core, and a shell part serving as an outer shell may be made of a sugar ingredient. In this way, the sugar crystals can be formed by compressing carbon dioxide with the outer shell of the sugar ingredient, and when such sugar crystals are dispersed inside a reconstituted tobacco leaf slurry, the outer shell of the sugar ingredient melts during heating of an aerosol-generating material so that carbon dioxide contained inside the sugar crystals may be emitted to the outside. Hereby, holes are formed in a space where sugar crystals inside the reconstituted tobacco leaf slurry exist so that there is an effect of easily migrating up to active ingredients present not only outside the reconstituted tobacco leaf slurry, but also inside the reconstituted tobacco leaf slurry, and the overall migration amount of the active ingredients can also be increased.

The active ingredients present inside the medium may correspond to active ingredients such as nicotine and the like, and may be migrated together with glycerin or propylene glycol (PG) for increasing the atomization amount during smoking of an aerosol-generating article.

A reconstituted tobacco leaf slurry of the aerosol-generating material can be formed into various shapes through processing, and can be prepared into, for example, a sheet shape or a spherical shape.

When a sheet-shaped reconstituted tobacco leaf slurry is processed according to one embodiment of the present disclosure, a processing method such as papermaking type, rolling type, or band casting type may be used.

Meanwhile, the aerosol-generating material produced according to one embodiment of the present disclosure may further comprise a substance such as a flavoring agent in addition to the reconstituted tobacco leaf slurry containing the sugar crystals, and types of such a flavoring agent may be one or more selected from the group consisting of mint, chocolate, cocoa, coffee, licorice, coriander, vanillin, ethyl vanillin, maltol, ethyl maltol, eucalyptol, acetic acid, breath freshener, incense, spices, bergamot oil, geranium oil, lemon oil, orange oil, lime oil, grapefruit oil, mint oil, ginger oil, Isosweet, and rosemary, but the present disclosure is not limited to the types listed above.

Hereinafter, a method for preparing an aerosol-generating material according to one embodiment of the present disclosure will be described.

The method for preparing an aerosol-generating material according to one embodiment of the present disclosure may comprise the steps of:

a) melting sugar at a temperature of 120° C. to 150° C. and injecting a gas into a liquid phase of the sugar;

b) forming sugar crystals by cooling the gas-injected sugar to 50° C. to 90° C.;

c) mixing an adhesive and the sugar crystals with a reconstituted tobacco leaf slurry: and d) processing the mixed reconstituted tobacco leaf slurry.

The sugar in the step a) refers to sugar such as sugar, and a gas such as carbon dioxide ($CO_2$) is first injected into the sugar under high temperatures and high pressures in order to form sugar crystals according to one embodiment of the present disclosure. Thereafter, the injected sugar is rapidly cooled to form sugar crystals.

In order to prepare a reconstituted tobacco leaf slurry, a raw material of reconstituted tobacco leaves is pulverized to prepare a raw material powder, the raw material powder is filtered, an adhesive is dissolved in a solvent, and then the adhesive solution and the filtered raw material powder are mixed to prepare a slurry.

The adhesive used herein may be, for example, gum arabic, guar gum, or xanthan gum, and the solvent may correspond to water, glycerin, or propylene glycol.

Thereafter, the sugar crystals prepared in the steps a) and b) are mixed with the slurry, and this is subjected to a processing method such as papermaking type, rolling type, or band casting type to prepare a reconstituted tobacco leaf slurry of a desired shape and an aerosol-generating material containing the same.

The aerosol-generating material prepared in this way is substantially the same as the aerosol-generating material according to one embodiment of the present disclosure described above, and through this, it may exhibit the effect capable of effectively migrating active ingredients present inside the tobacco medium.

Meanwhile, according to another embodiment of the present disclosure, there may be provided an aerosol-generating article comprising a tobacco medium part and a filter part, wherein the tobacco medium part contains an aerosol-generating material, the aerosol-generating material includes a reconstituted tobacco leaf slurry, the reconstituted tobacco leaf slurry contains sugar crystals containing a gas therein, and the filter part includes a cooling part.

Since the filter part includes a cooling part, an aerosol generated as the tobacco medium part is heated can be cooled, and the user can inhale the aerosol cooled to an appropriate temperature.

The cooling part may be made of cellulose acetate or paper, and may form a tubular structure including a hollow therein.

Further, while being located at the rear end of the tobacco medium part, the filter part may be composed of a plurality of segments or may be composed of a single segment.

In addition, the aerosol-generating article may correspond to a non-combustion type aerosol-generating article, and the above-described aerosol-generating material may be contained in a tobacco medium part constituting the aerosol-generating article.

Meanwhile, the aerosol-generating article may additionally comprise a front end plug in addition to the above configuration, and such a front end plug may be a cellulose acetate filter, a paper filter, or a filter made of a polymer material, and may contain a moisturizing agent.

The aerosol-generating article comprises a front end plug so that the tobacco medium part can be prevented from being separated to the outside, and the aerosol liquefied from the tobacco medium part can be prevented from flowing into the aerosol-generating device during smoking.

FIG. 1 shows an aerosol-generating article comprising a front end plug, FIG. 1 is one which shows a form according to an example of the present disclosure, but is not limited thereto. The front end plug corresponds to an additional constituent element of an aerosol-generating article according to one embodiment of the present disclosure, and the present disclosure can be implemented in various configurations except for the front end plug.

Meanwhile, the aerosol-generating article according to one embodiment of the present disclosure may constitute an aerosol-generating system together with an aerosol-generating device including a battery, a controller, a detector, and the like, and the aerosol-generating system may also additionally include a liquid-phase storage part containing an aerosol-generating material, and a cartridge including an atomizer for generating an aerosol.

The aerosol-generating material contained in the liquid-phase storage part may generally include at least one of propylene glycol (PG) and vegetable glycerin (VG), and may further include at least one of ethylene glycol, dipropylene glycol, diethylene glycol, triethylene glycol, tetraethylene glycol, and oleyl alcohol, and may include at least one of nicotine, moisture, and a flavoring agent.

Although the above-mentioned embodiments have been described by limited drawings, those skilled in the art may apply various technical modifications and alterations based on the above-mentioned description. For example, appropriate results can be achieved although described techniques are carried out in a different order from a described method, and/or described elements of a system, structure, apparatus, circuit, etc. are combined or mixed in a different form from the described method, or replaced or substituted with other elements or equivalents.

Therefore, other embodiments, other examples, and equivalents to patent claims belong to the scope of the patent claims to be described later.

The invention claimed is:

1. An aerosol-generating article comprising a tobacco medium part and a filter part, wherein the tobacco medium part contains an aerosol-generating material, the aerosol-generating material includes a solid reconstituted tobacco leaf formed from a slurry, the solid reconstituted tobacco leaf formed from a slurry contains sugar crystals containing a gas therein, and the filter part includes a cooling part.

2. The aerosol-generating article of claim 1, wherein the gas is carbon dioxide, and the sugar crystals are dispersed inside the solid reconstituted tobacco leaf formed from a slurry.

3. The aerosol-generating article of claim 1, wherein the cooling part is made of cellulose acetate or paper and has a tubular shape including a hollow.

4. The aerosol-generating article of claim 1, wherein the solid reconstituted tobacco leaf formed from a slurry has a sheet shape or a spherical shape.

5. The aerosol-generating article of claim 1, wherein the aerosol-generating material further comprises at least one flavoring agent selected from the group consisting of mint, chocolate, cocoa, coffee, licorice, coriander, vanillin, ethyl vanillin, maltol, ethyl maltol, eucalyptol, acetic acid, breath freshener, incense, spices, bergamot oil, geranium oil, lemon oil, orange oil, lime oil, grapefruit oil, mint oil, ginger oil, Isosweet, and rosemary.

* * * * *